United States Patent [19]

Loveless et al.

[11] 4,110,234

[45] Aug. 29, 1978

[54] ANTIOXIDANT STABILIZED LUBRICATING OILS

[75] Inventors: Frederick C. Loveless, Cheshire; Walter Nudenberg, Newtown, both of Conn.

[73] Assignee: Uniroyal, Inc., New York, N.Y.

[21] Appl. No.: 629,162

[22] Filed: Nov. 5, 1975

[51] Int. Cl.[2] ..... C10M 1/38

[52] U.S. Cl. ..... 252/47.5; 252/26; 252/47; 252/49.7; 252/400 R

[58] Field of Search ..... 252/26, 47, 47.5, 49.7, 252/400 R

[56] References Cited

U.S. PATENT DOCUMENTS

| | | | |
|---|---|---|---|
| 2,181,913 | 12/1939 | Rosen | 252/49.7 |
| 2,718,501 | 9/1955 | Harle | 252/47 |
| 2,813,076 | 11/1957 | Edelman et al. | 252/33.6 X |
| 3,129,185 | 4/1964 | Rizzuti et al. | 252/37.5 X |
| 3,296,136 | 1/1967 | Eickemeyer et al. | 252/47.5 |
| 3,422,014 | 1/1969 | Forbes et al. | 252/49.7 X |
| 3,505,225 | 4/1970 | Wheeler | 252/47.5 X |
| 3,634,238 | 1/1972 | Bridger | 252/26 |

*Primary Examiner*—Delbert E. Gantz
*Assistant Examiner*—Andrew H. Metz
*Attorney, Agent, or Firm*—Thomas A. Beck

[57] ABSTRACT

This invention is directed to oxidation resistant hydrocarbon oils and the making thereof. The oils are protected against oxidation by a synergistic antioxidant system comprising a mixture of a phenylated naphthylamine, a sulfur containing compound, and an oligodynamic amount of a specific metal or metal compound.

82 Claims, No Drawings

ANTIOXIDANT STABILIZED LUBRICATING OILS

The invention relates to improved hydrocarbon lubricating oils having incorporated therein a novel stabilizer system comprising a phenylated naphthylamine compound, a sulfide compound and specific metals or metal compounds, which system imparts to said oil a totally unexpected high degree of resistance with respect to oxidative breakdown.

The prior art discloses the stabilization of lubricating oils using various amines including p-phenylenediamine, diphenylamine and naphthylamine with various sulfur containing compounds in any type of oil. Some references indicate that such stabilizing system have been disclosed for use in lubricating oils of the synthetic hydrocarbon, petroleum mineral and ester types as well as solid polymers. In addition, amines in general have been useed with either sulfides or metals but not with both. Heretofore, there has been no recognition of the use of a specific class of amines along with both a sulfur containing compound and an oligodynamic amount of a metal or metal compound, which provides unexpected synergistic results in stabilizing synthetic hydrocarbon oils and certain mineral oils of very low unsaturation.

U.S. Pat. No. 2,718,501 discloses a stabilizing systemm for such oils as mineral hydrocarbon lubricating oils, synthetic hydrocarbon oils, polyalkylene glycol oils, diester oils, orthosilicate oils and polysiloxane oils. The stabilizer system is a combination of (1) an aromatic amine with at least two aromatic rings, i.e., diphenylamine, phenyl -α-naphthylamine, p-phenylene diamine, carbazole, phenothiazine, etc. and (2) an organic sulfur compound having the general formula $RS_xR_1$. All the examples in the reference are directed to a mineral hydrocarbon lubricating oil in admixture with various amines and such sulfur containing compounds as sulfides, polysulfices, and mercaptans.

U.S. Pat. No. 3,072,603 discloses a stabilizer system for poly-α-olefins comprising a combination of a diester of 3,3'-thiodipropionic acid and a nitrogen-containing compound of the following general formulae:

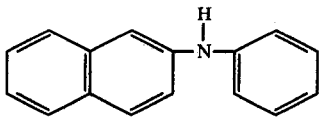

and

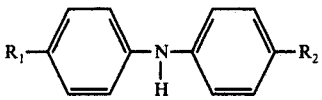

where $R_1$ and $R_2$ are selected from the group consisting of hydrogen and alkyl radicals having 1–12 carbon atoms. Of the long list of nitrogen-containing compounds, phenyl-β-naphthylamine is disclosed in column 2, line 35. Other compounds which are operable include the substituted p-phenylenediamines and the substituted diphenylamines. The above noted stabilizer system is especially useful for stabilizing solid resinous poly-α-olefins (e.g., polyethylene and polypropylene) having an average molecular weight of at least 15,000, preferably 20,000. There is no suggestion in this reference of the use of the system to stabilize lubricating oils of any type.

U.S. Pat. No. 3,505,225 discloses novel antioxidants which are derivatives of diphenylamine and phenylnaphthylamines which are effective alone, in combination eith each other, or in combination with dialkyl 3,3'-thiodipropionates; said antioxidant combinations are useful to stabilize petroleum or synthetic ester type lubricating oils. The use of the system with synthetic hyrocarbon oils is not disclosed. It is noted in Example 20 of the reference that a synthetic lubricant of the ester type is disclosed (Plexol 201J) wherein various nitrogen-containing compounds are used to stabilize the oil.

Reissue U.S. Pat. No. 26,158 discloses solid poly-α-olefin compositions employing a stabilizer composition of a diester of 3,3'-thiopropionic acid and a hydroxyl-containing amine. The stabilizer is primarily used in poly-α-olefins such as polyethylene and polypropylene.

U.S. Pat. No. 3,634,238 discloses both lubricating oil and grease compositions containing an antioxidant system comprising a mixture of an amine and a metal. There is a distinction neither between different types of oils nor between different types of amines. There is no suggestion of incorporating a sulfide therein.

Other patents suggesting the use of metals or metal soaps as acid scavengers and the like in anti-oxidant systems include U.S. Pat. Nos. 3,290,242; 3,231,497; 3,129,185; and 2,813,076.

The instant invention relates to oxidation resistant lubricating oil compositions, and in particular, relates to hydrocarbon lubricating oils which are unexpectedly highly stabilized against oxidative degradation by the addition of a combination of specific additives.

It is thus an object of this invention to produce a hydrocarbon lubricating oil for use where high temperatures are involved. For example, lubricating oils employed in internal combustion engines and the like must be resistant to high temperature oxidative degradation.

It is an object of this invention to produce a lubricating oil which provides after aging essentially no acid build-up, no sludge formation, no metal corrosion, and a very small increase in viscosity.

It has been discovered that a stabilizer system comprising certain nitrogen-containing compounds, certain sulfur-containing compounds and specific metal or metal compounds in admixture with a hydrocarbon oil of low unsaturation produces a lubrication product with unexpectedly far superior oxidation resistance compared with commercially available hydrocarbon oils presently on the market.

The specific nitrogen-containing compounds usable herein are the phenylated naphthylamines and their derivatives. These compounds are best represented by the following formulae:

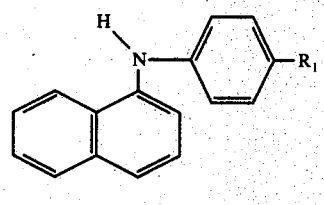

and

-continued

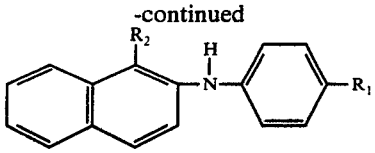

where $R_1$ and $R_2$ may be hydrogen, alkyl with 1 to 12 carbon atoms, aryl with 6 to 20 carbon atoms, and aralkyl or alkaryl with 7 to 20 carbon atoms. Preferably $R_1$ is hydrogen; tertiary pentyl; 1,1', 3,3'-tetramethyl butyl; 1,1',3,3',5,5'-hexamethyl hexyl; $\alpha,\alpha$,-dimethyl benzyl triphenyl methyl and the like as described in U.S. Pat. No. 3,505,225, incorporated herein by reference; and $R_2$ is hydrogen, $\alpha$, $\alpha$ - dimethyl benzyl; alphamethyl benzhydryl; triphenylmethyl and alpha, alpha, p-trimethyl benzyl. In addition, the oxidized forms of these amines may be used.

The sulfur-containing compounds to be used in accordance with the present invention may be generically termed sulfides. The sulfides, either mono or di, have the general formula R—S—R or R—SS—R wherein the R groups may be the same or different and are selected from alkyl, aryl, aralkyl, alkaryl, alkanoate, thiazole, imidazole, phosphorothionate and $\beta$-ketoalkyl groups.

More particularly, the preferred sulfides are selected from the following types:

$$-S\,[\,(CH_2)_xCOOR]_2 \qquad (1)$$

wherein x is from about 2 to 5 and R is an alkyl radical having from about 4 to 20 carbon atoms. R may be either a straight chain or a branched chain radical that is large enough to maintain solubility of the dialkylthiodialkanoate in the oil upon cooling. Typical diesters would include the butyl, amyl, hexyl, heptyl, octyl, nonyl, decyl, tridecyl, myristyl, pentadecyl, cetyl, heptadecyl, stearyl, lauryl, and eicosyl diesters of thiodialkanoic acids such as propionic, butanoic, pentanoic and hexanoic acids. Of the diester sulfides, the preferred compound is dilauryl 3,3'-thiodipropionate due to its ready availability.

$$R_1—S—R_2 \qquad (2)$$

wherein the R groups are the same or different and are alkyl radicals having from 1 to 20 carbon atoms, aryl rdicals hving from 6 to 20 carbon atoms, alkaryl radicals having from 7 to 20 carbon atoms, aralkyl radicals having from 7 to 20 carbon atoms or thiazole, imidazole, phosphorothionate, or $\beta$-ketoalkyl radicals; except that $R_1$ and $R_2$ may not both be phenyl. When $R_1$ or $R_2$ is an alkyl radical, it may be saturated or unsaturated, straight chain or branched. When $R_1$ or $R_2$ contain aromatic groups the compounds are less effective the closer the aromatic ring is to the sulfur atom. Thuss, as shown by example hereinafter, diphenyl sulfide is inoperative, whereas dibenzyl sulfide is operative, and bis(2-phenylethyl) sulfide provides excellent stability. In addition dialkyl sulfides are more effective than alkylaryl sulfides which are, in turn, more effective than diaryl sulfides. Generally, compounds with more than one phenyl-sulfur bond are considered inoperative herein.

$$R_1—S—S—R_2 \qquad (3)$$

wherein the R groups are selected from the group as defined in (2) above with the same limitation that compounds with more than one phenyl-sulfur bond are inoperative.

In addition to the phenylated naphthylamine and the sulfide, an antioxidant composition further includes an oligodynamic amount of a specific metal or a metal compound.

The metals which may be used herein are those having a modicum of solubility in the hydrocarbon oil. With the exception of silver (atomic number 47), the suitable metals are generally those selected from Groups VIII, Ib and IIb of the periodic Table of Elements with atomic numbers greater than 26. Preferably the metals are selected from cobalt, nickel, copper, zinc and rhodium. Surprisingly, it has been determined that iron and silver do not provide any synergism in the unique stabilizing system of the invention. Magnesium was also found ineffective in the present invention.

The metal may be added to the oil in any of several ways with the requirement that enough but not too much, i.e. about .01 to 25 ppm, of the metal be present to synergistically interact with the other components. It may be added to the oil in the form of a compatible soluble salt, preferably an organic salt due to a greater solubility in the oil. Alternatively, a piece of the metal may be placed into the oil so that the oil is in contact with it. Thirdly, the metal may become available to synergistically interact with the other components of the antioxidant system in the oil by being present in the engine or equipment in which the oil is used, i.e., the slight amounts of metal necessary are provided by contact of the oil with the surfaces of the engine.

When the metal is provided by means of the addition of a metallic salt to the oil, the preferable salts include naphthenates, stearates, acetylacetonates, octoates, decanoates, and other such long chain radicals.

Most preferably the metal incorporated herein is copper, and especially in the form of a copper salt such as copper naphthenate.

The synthetic hydrocarbon oils to which the antioxidant system is added, are those produced from alpha-olefins of $C_3$ to $C_{14}$ and higher, such as propene, butene, pentene, hexene, heptene, octene, nonene, decene, undecene, dodecenee, tridecene, and tetradecene, which are oligomerized to produce a lubricating oil. Normally, hydrocarbon oligomers below $C_{20}$ are too volatile for use as lubricating oils, whereas hydrocarbon oligomers averaging much above $C_{60}$ have a pour point too high for certain low temperature applications. Accordingly, the synthetic hydrocarbon oils usable herein are those having average molecular weights essentially between about 280 and 1,000, preferably between 350 and 840. A required feature of the synthetic hydrocarbon oil is that it be of low unsaturation. It has been determined (see Example II hereinafter) that there is a substantially direct relationship between the moles of unsaturation (C=C) and the effectivenss of the antioxidant system. Thus, the synthetic oil should have less than about 0.25 mole of (C=C) per 1,000 gm. of oil, preferably less than 0.15, and most preferably less than 0.05.

The mineral oils for which the present antioxidant system exhibits the synergistic results are saturated hydrocarbon based mineral oils which are substantially acid free and which possess less than about 0.15 mole of (C=C) per 1,000 gm of oil, preferably less than 0.1, and most preferably less than 0.05. The expression "acid free" as used herein in connection with the mineral oils means that said mineral oils are substantially free of the type of substance which is capable of giving up a proton

(Lowry-Bronsted) or which can take up an electron pair to form a covalent bond (Lewis). These substances range in strength from phenal to the strong mineral acids. It has been determined that the use of the stabilizer system of the present invention in combination with a mineral oil containing a discernable amount of acid results in an oxidative breakdown of the oil, which is a result totally opposite to that obtained in the present invention. The difference in the required levels of unsaturation between synthetic hydrocarbon oils and mineral oils is due to the inherently greater instability of the mineral oils.

The various components of the antioxidant system which may be added in any order are used in the following amounts. The phenylated naphthylamine is used in amounts varying from about 0.15 to 1.25 parts by weight per 100 parts of the oil, preferably 0.2 to 0.7 part, and most preferably 0.3 to 0.6 part. The sulfide, although being essential for the system, may be used in amounts from about 0.05 to 4.0 parts by weight per 100 parts of oil, preferably about 0.2 to 1.0 part.

The metals are used in amounts such as to provide about 0.01 to 25 parts per million of the metal to the oil. Preferably, the amount is in the range of 1 to 15 parts per million. When copper is the metal, the most preferable range is 1 to 10 ppm.

The criteria used herein to evaluate the effectiveness of an antioxidant for lubricating oils are: 1) the amount of sludge produced; 2) the change in initial viscosity; 3) the change in neutralization number and 4) the weight change of the test metals. These criteria are determined after the oil sample containing the improved antioxidant system has been aged for 72 hours at 370° F. The standard which is adopted for the purpose of evaluating the instant invention as well as the standard adopted by commercial enterprises having an interest in this subject matter is that after aging the sample for 72 hours at 370° F there should ideally be substantially 1) no sludge formed, 2) no change from the initial viscosity, 3) no change in the neutralization number and 4) no weight change in the metals. The closer one comes to these ideal standards the more commercially acceptable the lubricating oil will be.

The following examples illustrate the invention in greater detail:

EXAMPLE I

This example shows the outstanding synergistic result of using the stabilizer system of the present invention to protect a low unsaturated synthetic hydrocarbon oil against oxidative degradation. The oil used was a polyoctene-based oil having 0.02 mole of unsaturation per 1,000 grams of oil and an average molecular weight of about 600.

Various samples were prepared in order to evaluate the effectiveness of the stabilizer system. The first sample was prepared by adding phenyl-α-naphthylamine and dilaurylthiodipropionate in the amounts set forth in Table I, to 100 grams (about 125 ml) of the polyoctene-based oil and heating to about 100° C, in order to facilitate the dissolution of the additives. The copper metal was incorporated as a metal washer as shown below. Other samples subsequently prepared contained one or two of the amine, sulfide and metal compounds but not all three. The amounts used in each case are set forth in Table I.

Each of the samples was tested according to the following test procedures: A 100 ml. sample having the compositions set forth in Table I is poured into a pyrex glass test cell and aged by inserting one end of a glass air delivery tube into the test cell while the remaining 25 ml portions of each original oil sample is set aside and analyzed for neutralization number and Saybolt viscosity at 100° F. Around this tube immersed in the oil were placed from zero to four metal washers (Mg, Cu, Ag and FE) as identified in Table I. When more than one washer was used, they were separated from each other by glass spacers. These remained in the oil during the aging process and served to indicate the extent of corrosion of the oil on metal. The test cell was then fitted with a reflux condenser. The assembly was placed in a constant temperature aluminum block. An air hose was then attached to the other end of the air delivery tube and the air flow was adjusted so that five liters of air per hour was bubbled through the oil. This aging test was carried out for 72 hours at 370° F. After aging, the oil was filtered hot and the amount of sludge developed was collected and was determined and recorded in milligrams per 100 ml. of oil. The filtered oil was then analyzed to determine changes in neutralization number and Saybolt viscosity at 100° F.

The neutralization number was determined by the color-indicator titration method according to ASTM procedure D974-55T.

The Saybolt viscosity was determined on a standard Saybolt viscometer according to ASTM procedure D445-53T.

The metal washers, which were weighed initially, were then carefully washed and weighed again to determine the weight change in grams.

The data in Table I dramatically show that when a sulfide such as dilauryl thiodipropionate and a phenylated naphthylamine such as phenyl-α-naphthylamine are added to a synthetic hydrocarbon oil together with copper metal the aged properties of the oil are excellent as noted by very little change in the viscosity or neutralization number, very low sludge and essentially no weight change in the metals.

It is also noted that if either the amine or the sulfur compound are used individually with the copper, essentially no protection is afforded the oil.

If there is no entry for weight change for a metal in Table I, then that metal was not included in the test. The total surface area for each of the washers was about 5 square centimeters.

TABLE I

Results of Example I

| | Oil[1] | DLTDP[2] | PAN[3] | (ppm)[4] | % $\Delta V_{100}$[5] | N.N.[6] | Sludge (in mg.) | Weight Change (in grams) of Washers | | | |
|---|---|---|---|---|---|---|---|---|---|---|---|
| | | | | | | | | Mg | Fe | Cu | Ag |
| A | 100 | 0.25 | 0.50 | 1-5 | 1.8 | 0 | 2.6 | −.0001 | −.0001 | −.000. | −.0003 |
| B | 100 | 0 | 0.50 | 1-5 | 22.0 | 3.46 | 1320.1 | −.1511 | +.0002 | −.0014 | +.0004 |
| C | 100 | 0.25 | 0 | 1-5 | 40.6 | 7.6 | 3542. | +.0051 | +.0011 | −.0101 | +.0002 |
| D | 100 | 0.25 | 0 | 0 | 52.0 | 8.3 | 410.4 | | | | |
| E | 100 | 0 | 0.50 | 0 | 111. | 12.2 | 30.4 | | | | |
| F | 100 | 0.25 | 0.50 | 0 | 8.4 | 1.65 | 151.0 | | | | |
| G | 100 | 0.25 | 0.50 | 0 | 7.2 | 1.78 | 136.2 | −.0001 | | | |
| H | 100 | 0.25 | 0.50 | 0 | 7.2 | 1.97 | 156.6 | | | | −.0001 |

TABLE I-continued

Results of Example I

| | Oil[1] | DLTDP[2] | PAN[3] | (ppm)[4] | % $\Delta V_{100}$[5] | N.N.[6] | Sludge (in mg.) | Weight Change (in grams) of Washers Mg | Fe | Cu | Ag |
|---|---|---|---|---|---|---|---|---|---|---|---|
| I | 100 | 0.25 | 0.50 | 0 | 7.8 | 2.2 | 193.6 | | +.0000 | | |
| J | 100 | 0.25 | 0.50 | 0 | 10.0 | 2.5 | 134.5 | +.0000 | +.0001 | | −.0001 |
| K | 100 | 0.25 | 0.50 | 1-5 | 2.2 | 0.23 | 14.9 | | | +.0001 | |
| L | 100 | 0.25 | 0.50 | 1-5 | 4.1 | 0.20 | 18.3 | | +.0000 | +.0000 | |

Legend:
[1]Oil - polyoctene based oil, gms.
[2]DLTDP - dilaurylthiodipropionate, gms.
[3]PAN - phenyl-α-naphthylamine, gms.
[4]1-5 ppm copper provided by washer as determined by extrapolation from Example X below.
[5]% ΔV 100 - percent change in viscosity at 100° F.
[6]N.N. - neutralization number of aged oil.

EXAMPLE II

This example dramatically demonstrates the effect of the level of unsaturation of the synthetic hydrocarbon oils on the stability of the oil, where the unsaturation is expressed as moles of unsaturation per 1000 gm. of oil. The procedure of Example I was repeated to prepare the test samples using a sulfur containing compound (dilauryl thiodipropionate) and a naphthylamine (phenyl-α-naphthylamine), as stabilizers (0.25 and 0.50 part/100 parts of oil respectively) and a metal (copper, in the form of washer). The oils were all polyoctenes.

The data in the table below clearly point out that as the amount of unsaturation in the oil is lowered the aged physical properties improve measurably with respect to decreasing amounts of sludge, less change in viscosity, lower neutral number, and reduced metal weight change.

TABLE II

| Sample | Moles of C=C 1000 gm oil | Sludge (in mg) | %$\Delta V_{100}$ | N. N. | Weight Changes in Grams Mg | Fe | Cu | Ag |
|---|---|---|---|---|---|---|---|---|
| A | 1.16 | 1023 | +52.5 | 8.2 | +.0092 | +.0009 | −.0021 | +.0002 |
| B | 0.785 | 835 | +33.8 | 6.5 | +.0057 | +.0005 | −.0017 | +.0003 |
| C | 0.400 | 612 | +25.2 | 5.3 | +.0029 | +.0002 | −.0020 | +.0003 |
| D | 0.262 | 301 | +20.5 | 4.3 | +.0009 | +.0002 | −.0013 | 0 |
| E | 0.185 | 149 | +11.9 | 2.6 | +.0004 | +.0002 | −.0012 | +.0001 |
| F | 0.154 | 124 | +11.5 | 1.7 | +.0001 | 0 | −.0007 | +.0002 |
| G | 0.138 | 54.2 | + 8.1 | 1.3 | +.0001 | 0 | +.0001 | −.0002 |
| H | 0.0925 | 18.1 | + 5.1 | 0.68 | +.0001 | +.0001 | 0 | +.0001 |
| J | 0.045 | 6.3 | + 4.2 | 0.22 | 0 | 0 | 0 | 0 |
| K | 0.020 | 2.6 | + 1.8 | 0 | −.0001 | −.0001 | −.0001 | −.0003 |

EXAMPLE III

This example demonstrates how changes in the level of phenyl-α-naphthylamine affect the stabilization of a low unsaturated polyoctene oil (0.02 mole C=C/1000 grams of oil) while maintaining a constant dialkyl-3,3'-thiodipropionate level in the presence of a constant amount of copper metal. The samples were prepared as in Example I using the amounts of ingredients as shown in Table III.

The data in Table III show that when a level of from 0.15 to 1.0 part phenyl-α-naphthylamine used in conjunction with 0.25 part of dilauryl-3,3'-thiodipropionate a low unsaturated oil is effectively stabilized while the preferred level of phenyl-α-naphthylamine is shown to be from 0.20 to 0.70 part.

It can be seen from the results of Table III that the level of the phenyl-α-naphthylamine is critical in producing a synthetic hydrocarbon oil having outstanding aged physical properties while maintaining the sulfur containing compound at a constant level. The prior art, on the other hand, shows no specificity for either the amine or the sulfur containing compound. As can be seen in the results, this invention is surprisingly inoperable at the extreme range levels disclosed in both U.S. Pat. No. 3,072,603 and U.S. Pat. No. 3,505,225. Therefore, if the amount of phenyl-α-naphthylamine falls outside the limits of 0.15 to 1.25 parts, preferably 0.2 to 0.7 part, a dramatic deterioration of the aged oil takes place.

TABLE III

| Sample | DLTDP | PAN | % $\Delta V_{100}$ | N. N. | Sludge Sludge (in mg) | Weight Change - in grams Mg | Fe | Cu | Ag |
|---|---|---|---|---|---|---|---|---|---|
| A | 0.25 | 0 | +40.6 | 7.6 | 3542 | +.0051 | +.0011 | −.0101 | +.0002 |
| B | 0.25 | 0.1 | +30.9 | 3.97 | 587.2 | +.0041 | +.0005 | −.0030 | +.0001 |
| C | 0.25 | 0.15 | +10.6 | 2.42 | 260.9 | +.0011 | +.0004 | −.0015 | −.0001 |
| D | 0.25 | 0.25 | + 4.3 | 0.79 | 58.8 | +.0001 | +.0001 | −.0002 | −.0004 |
| E | 0.25 | 0.30 | + 1.2 | 0 | 0.4 | +.0002 | +.0002 | +.0001 | −.0003 |
| F | 0.25 | 0.35 | + 2.2 | 0 | 1.1 | +.0003 | +.0004 | +.0002 | −.0001 |
| G | 0.25 | 0.40 | + 5.2 | 0 | 1.1 | +.0003 | +.0003 | −.0002 | |
| | | | | | | | 0 | | |
| H | 0.25 | 0.45 | + 4.7 | 0 | 1.2 | +.0001 | +.0002 | +.0001 | −.0004 |
| J | 0.25 | 0.50 | + 4.7 | 0 | 4 | +.0002 | +.0003 | +.0005 | 0 |
| K | 0.25 | 1.0 | +14.1 | 0.27 | 72 | 0 | +.0001 | +.0002 | 0 |
| L | 0.25 | 2.0 | +28.4 | 3.0 | 787 | +.0002 | +.0002 | +.0003 | 0 |
| M | 0.25 | 4.0 | +41.3 | 4.6 | 2022 | +.0001 | +.0001 | +.0006 | +.0001 |

EXAMPLE IV

This example demonstrates how changes in the level of a dialkyl-3,3'-thiodipropionate affects the stabilization of a low unsaturated synthetic hydrocarbon oil (0.02 mole C=C/1000 gms of oil) while maintaining constant phenyl-α-naphthylamine, and copper metal levels. The samples were prepared as in Example I.

The data in Table IV demonstrate that the dilauryl-3,3'-thiodipropionate is effective at essentially any level and that the amount used is not critical. It does appear that with larger amounts there is better control of viscosity changes.

TABLE IV

| Sample | DLTDP | PAN | % $\Delta V_{100}$ | N. N. | Sludge (in mg.) | Weight Change - in grams Mg | Fe | Cu | Ag |
|---|---|---|---|---|---|---|---|---|---|
| A | 0 | 0.5 | + 22 | 3.46 | 1320.1 | −.1511 | +.0002 | −.0014 | +.0004 |
| B | .05 | 0.5 | +8.1 | 0.25 | 11.3 | +.0001 | −.0001 | 0 | −.0003 |
| C | 0.1 | 0.5 | +6.5 | 0 | 8.4 | +.0001 | +.0001 | +.0002 | −.0001 |
| D | 0.15 | 0.5 | +4.1 | 0 | 5.0 | 0 | +.0001 | +.0002 | +.0001 |
| E | 0.2 | 0.5 | +5.8 | 0 | 1.7 | +.0001 | +.0002 | +.0003 | 0 |
| F | 0.25 | 0.5 | +4.9 | 0 | 4 | +.0001 | +.0001 | +.0001 | −.0002 |
| G | 0.5 | 0.5 | +4.4 | 0.23 | 15.6 | +.0001 | 0 | 0 | −.0005 |
| H | 2.0 | 0.5 | +1.3 | 0.43 | 3.7 | +.0001 | +.0001 | −.0003 | 0 |
| J | 4.0 | 0.5 | 0 | 0.24 | 6.9 | +.0001 | 0 | −.0010 | −.0001 |

EXAMPLE V

This example is not to be considered part of the invention, but it is being included to demonstrate the non-stabilizing effect of a preferred sulfide (dilauryl-3,3'-thiodipropionate), a preferred phenylated naphthylamine (phenyl-α-naphthylamine) and a preferred metal (copper) on an ester oil of the type disclosed in U.S. Pat. No. 3,505,225. The samples were prepared as in Example I using the ester oil in place of the hydrocarbon oil.

The data below in Table V dramatically show the ineffectiveness of the synergistic antioxidant combination in protecting the Plexol 201-J ester fluid. In every case, whether the amine or the sulfide are employed either solely with the copper metal or together therewith sludge values are so extremely high after aging with little or no protection against metal corrosion as judged by the large weight change of the copper metal and with the magnesium metal being completely dissolved, that the antioxidant system is essentially inoperative.

TABLE V

| Example | Oil | DLTDP | PAN | % $\Delta V_{100}$ | N. N. | Sludge (in mg) | Metal Corrosion (in grams) Mg | Fe | Cu | Ag |
|---|---|---|---|---|---|---|---|---|---|---|
| A | Plexol 201-J [1] | 0.25 | 0 | +10.9 | 9.74 | 8648 | Dissolved | +.0001 | −.0546 | 0 |
| B | " | 0 | 0.5 | +10.2 | 10.75 | 4057 | Dissolved | −.0002 | −.0455 | +.0001 |
| C | " | 0.25 | 0.5 | +14.3 | 15.44 | 4676 | Dissolved | +.0003 | −.0148 | +.0011 |
| D | " | 0 | 0 | +24.7 | 16.75 | 4819 | Dissolved | +.0002 | −.0407 | +.0001 |

[1] di(2-ethylhexyl)sebacate oil

EXAMPLE VI

This example shows the use of mineral oils with a preferred synergistic antioxidant system herein.

Various mineral oils were tested having different levels of unsaturation both with and without the complete system of (1) 0.50 part of phenyl-α-naphthylamine, (2) 0.25 part of dilaurylthiodipropionate, and (3) copper in the form of a metal washer. Those tested without the complete system did have the metal included.

The oils used were: (1) a mineral oil base fluid coded TL-6600 having a Saybolt viscosity at 100° F of 128.2 SUS before aging and about 0.24 mole of unsaturation/1000 grams of oil; (2) a refined version of (1) wherein the fluid was treated with sulfuric acid and then washed with sodium hydroxide and water, separated and dried, and having about 0.08 mole of unsaturation/1000 grams of oil; (3) a highly refined white mineral oil identified as ERVOL from Witco Chemical with a Saybolt viscosity of 137.7 SUS at 100° F and having about 0.03 mole of unsaturation/1000 grams of oil and (4) a chromatographed version of (3) wherein the oil had about 0.01 mole of unsaturation per 1000 grams of oil.

The samples were prepared and tested in accordance with the procedure of Example I.

As can be seen from the results in Table VI, the first oil (0.24 mole unsaturation/1000 grams of oil is unprotected by synergistic antioxidant system whereas the other oils having unsaturation levels below 0.1 mole/1000 gms of oil were indeed protected. Thus the higher criticality of the unsaturation level for mineral oils as compared to synthetic hydrocarbon oils is readily shown.

TABLE VI

| Sample | Unsaturation level of Oil (moles/1000 gms) | Antioxidant System | % $\Delta V_{100}$ | N. N. | Sludge (in mg.) | Weight Change in grams Mg | Fe | Cu | Ag |
|---|---|---|---|---|---|---|---|---|---|
| A | 0.24 | NO[1] | +21.6 | 3.7 | 1590 | +.0137 | +.0003 | −.0034 | +.0009 |
| B | 0.24 | YES | +39.7 | 5.8 | 3396 | +.0045 | +.0024 | +.0001 | +.0022 |
| C | 0.08 | NO | +71.2 | 8.6 | 9612 | dis-solved | +.0003 | −.0251 | +.0001 |
| D | 0.08 | YES | +18.6 | 2.8 | 175 | +.0001 | +.0001 | −.0008 | +.0001 |
| E | 0.03 | NO | Failed - Sample would not filter dissolved | | | | −.0019 | −.0063 | −.0001 |
| F | 0.03 | YES | +19.9 | 2.4 | 188.2 | −.0001 | −.0002 | −.0013 | −.0001 |
| G | 0.01 | YES | + 4.9 | 0.2 | 33.7 | +.0001 | +.0001 | 0 | 0 |

[1] NO indicates that no phenyl-α-naphthylamine or dilaurylthiodipropionate was incorporated into the test sample.

EXAMPLE VII

Due to the inherent instability of mineral oils, the oil of Example VI having 0.03 mole of unsaturation/1000 grams of oil was tested in accordance with the previous procedure but at 347° F for 6 days as opposed to 370° F for 3 days. The results as shown in Table VII clearly demonstrate the synergistic results of the three component antioxidant system. The samples were prepared in accordance with Example I except sample F. For this sample, copper was added to the oil in the form of copper naphthenate at the same time as the phenyl-α-naphthylamine and the dilaurylthiodipropionate, and then the entire mixture was heated to about 100° f to facilitate dissolution.

TABLE VII

| Sample | Pan | Dltdp | Copper Metal | N. N. | % $\Delta V_{100}$ | Sludge (mg) |
|---|---|---|---|---|---|---|
| A | — | — | YES | 15.2 | +162 | 11,941 |
| B | — | 0.25 | YES | 14.9 | + 80 | 7,439 |
| C | 0.5 | — | YES | 11.1 | + 102 | 6,357 |
| D | 0.5 | 0.25 | YES | 0 | + 5.5 | 39.9 |
| E | 0.5 | 0.25 | NO | 3.4 | +14 | 209.4 |
| F | 0.5 | 0.25 | YES* | 4.2 | + 8.4 | 22.2 |
| G | 0.5 | 2.0 | YES | 0.25 | +4.5 | 58.7 |
| H | 1.0 | 2.0 | YES | 0.25 | + 8.1 | 153.2 |

*Copper added as 5 ppm copper naphthenate - all other samples had copper washers.

EXAMPLE VIII

This example shows that a sulfide such as dilauryl-3,3'-thiodipropionate in the presence of copper metal in combination with other phenylated naphthylamines are effective stabilizers for synthetic hydrocarbon oils. The oil used was the same as in Example I and the samples were likewise prepared and tested in accordance with Example I. The results are shown below in Table VIII.

TABLE VIII

| Sample | DLDTP | Amine | % $\Delta V_{100}$ | N. N. | Sludge (in mg.) | Weight Change in grams Mg | Fe | Cu | Ag |
|---|---|---|---|---|---|---|---|---|---|
| A | 0.20 | 0.5 | +6.8 | 0.52 | 28.7 | +.0002 | +.0001 | 0 | −.0004 |
| B | 0.1 | 0.5 | +6.5 | 0 | 13.3 | +.0006 | +.0004 | +.0005 | 0 |
| C | 0.25 | 0.5 | +5.3 | 0.29 | 1.1 | +.0003 | +.0002 | 0 | 0 |
| D | 0.25 | 0.5 | +5.3 | 0.57 | 65.5 | +.0003 | −.0003 | −.0005 | 0 |

A N-(4-alpha,alpha-dimethylbenzyl phenyl)-α-naphthylamine as described in U. S. Pat. 3,505,225.
B Oxidized phenyl-α-naphthylamine as described in U. S. Pat. 3,573,206.
C LO-6, a commercially available p-octyl phenyl-α-naphtylamine marketed by Ciba-Geigy Chemical Co. and described in U. S. Pat. 3,414,618.
D Phenyl-β-naphthylamine, - a commercially available antioxidant marketed under the trade name "PBNA" by Uiroyal, Inc.

EXAMPLE IX

This example shows that a preferred sulfur containing compound together with copper metal in combination with amines other than those of the phenylated naphthylamine type are ineffective as stabilizers for synthetic hydrocarbon oils. The oil used was the same as in Example I. The samples were prepared and tested as in Example I.

The data in Table IX clearly point out that even though these amines, like those disclosed in Example VIII, ar effective stabilizers for solid polymers and ester lubricating fluids, they are surprisingly not effective in synthetic hydrocarbon oils and do not produce synergistic stabilizing results.

TABLE IX

| Sample | DLTDP | Amine | %$\Delta V_{100}$ | N. N. | Sludge (in mg.) | Weight Change in grams Mg | Fe | Cu | Ag |
|---|---|---|---|---|---|---|---|---|---|
| A | 0.25 | 0.5 | +21.2 | 6.27 | 1038.4 | +.0064 | +.0007 | −.0025 | +.0010 |
| B | 0.2 | 0.5 | +27 | 3.50 | 786.4 | −.1288 | −.0019 | −.0010 | −.0003 |

A 4,4'-dioctyl diphenylamine
B An N-alkyl, N'-phenyl-p-phenylenediamine, - a commercially available antioxidant marketed under the trade name "Flexzone 11-L" by Uniroyl, Inc.

EXAMPLE X

This example demonstrates that numerous metals may be used in conjunction with a phenylated naphthylamine and a sulfide to produce a synergistic antioxidant system. In order to provide the metals herein, various salts were dissolved in the oils at the same time as the amine and the sulfide as disclosed in Example I to yield the metal concentrations as indicated in Table X. In each case 0.25 part of dilauryl-3,3'-thiodipropionate and 0.5 part of phenyl-α-naphthylamine were incorporated into the oil which was the same as in Example I. No metal washers were included in the testing of the systems.

The results show that when the amount of the metal, especially copper, increases above about 25 ppm, the properties of the oil have deteriorated.

TABLE X

| Sample | Metal | Conc (ppm) | N. N. | % $\Delta V_{100}$ | Sludge (mg) |
|---|---|---|---|---|---|
| A | Copper | 100 | 5.9 | 25.3 | 1255.1 |
| B | Copper | 75 | 3.5 | 14.5 | 601.7 |
| C | Copper | 50 | 2.4 | 10.4 | 441.2 |
| D | Copper | 25 | 0 | 6.0 | 39.0 |
| E | Copper | 10 | 0 | 4.3 | 11.3 |
| F | Copper | 5 | 0 | 4.2 | 2.7 |
| G | Copper | 1 | 0 | 4.4 | 7.8 |
| H | Copper | 0.5 | 0 | 4.5 | 22.3 |
| I | Copper | 0.25 | 0 | 4.5 | 35.7 |
| J | Copper | 0.1 | 0.80 | 5.5 | 67.3 |
| K | Copper | 0.01 | 0.80 | 6.8 | 61.7 |
| L | None | — | 1.65 | 8.4 | 151.0 |
| M | Cobalt | 9 | 0.27 | 5.7 | 28.1 |
| N | Cobalt | 11 | 0.27 | 5.2 | 44.3 |
| O | Nickel | 11 | 0.79 | 5.7 | 85.8 |
| P | Rhodium | 17 | 0.27 | 4.3 | 47.2 |

Samples A - K copper from copper naphthenate
Sample M cobalt from Manobond C (18%) - an ethylene diamine complex containing Boron and marketed by Manobond Corp.
Sample N cobalt from cobalt acetylacetonate
Sample O nickel from nickel acetylacetonate
Sample P rhodium from rhodium acetylacetonate

EXAMPLE XI

This example demonstrates that simple substituted monosulfides, other than the thiodipropionate esters as shown in the previous examples, are synergistic with the phenylated napthylamines and the copper metal in stabilizing synthetic hydrocarbon oils. The samples were prepared in accordance with Example I. As can be seen in Table XI, sulfides having aromatic groups directly attached to the sulfur are less effective the closer the aromatic group is to the sulfur atom. Thus, as shown, diphenyl sulfide is inoperative whereas dibenzyl sulfide is acceptable and benzyl-2-phenylethyl sulfide is excellent. In each case below, the metal weight changes of the washers were negligible. The oil used was the same as in Example I.

TABLE XI

| Sample | Sulfide | PAN | Copper | Sludge (mg) | N. N. | % $\Delta V_{100}$ |
|---|---|---|---|---|---|---|
| A | 0.25 | 0.5 | 1-5 | failed test -would not filter | | |
| B | 0.25 | 0.5 | 1-5 | 929 | 2.72 | +11.3 |
| C | 0.1 | 0.5 | 1-5 | 303 | 1.89 | +12.2 |
| D | 0.25 | 0.5 | 1-5 | 256 | 1.60 | +11.9 |
| E | 0.25 | 0.5 | 1-5 | 133 | 0.25 | + 5.0 |
| F | 0.25 | 0.5 | 1-5 | 58.4 | 0 | + 5.4 |
| G | 0.25 | 0.5 | 1-5 | 19.3 | 0.23 | + 2.1 |
| H | 0.25 | 0.5 | 1-5 | 39.3 | 0.24 | + 3.3 |
| I | 0.25 | 0.5 | 1-5 | 11.8 | 0.22 | + 4.1 |
| J | 0.25 | 0.5 | 1-5 | 9.9 | 0 | + 4.3 |
| K | 0.1 | 0.5 | 1-5 | 4.2 | 0 | + 3.0 |
| L | 0.25 | 0.5 | 1-5 | 7.8 | 0.52 | + 2.9 |

A Diphenyl sulfide
B m-bis(thio-2-phenylethyl)benzene
C Phenyl-3,7-dimethyl-6-octenyl sulfide
D Dibenzyl sulfide
E 2-Benzyl thioacetophenone
F Bis(2-phenylethyl)sulfide
G Benzyl-2-phenylethyl sulfide
H Benzyl methyl sulfide
I Benzyl ethyl sulfide
J Methyl-2-phenylethyl sulfide
K Benzyl-3,7-dimethyl-6-octenyl sulfide
L Didodecyl sulfide

EXAMPLE XII

This example demonstrates that myriad sulfide compounds, both mono- and di-sulfides, are synergistic with phenyl-α-naphthylamine and copper metal in stabilizing synthetic hydrocarbon oils of low unsaturation. The oil used herein was the same as in Example I, as was the sample preparation procedure. The results are shown in Table XII.

TABLE XII

| Sample | Sulfide | PAN | Copper | Sludge (mg) | N. N. | % $\Delta V_{100}$ |
|---|---|---|---|---|---|---|
| A | 0.20 | 0.5 | 1-5 | 22.9 | 0.27 | + 4.3 |
| B | 0.20 | 0.5 | 1-5 | 4.4 | 0 | + 2.5 |
| C | 0.10 | 0.5 | 1-5 | 239.9 | 2.41 | +17.8 |
| D | 0.25 | 0.5 | 1-5 | 53.6 | 0.22 | + 5.0 |
| E | 0.10 | 0.5 | 1-5 | 26.4 | 0 | + 3.3 |
| F | 0.10 | 0.5 | 1-5 | 169.9 | 0.28 | + 2.6 |
| G | 0.25 | 0.5 | 1-5 | 6.3 | 0 | + 3.6 |

TABLE XII-continued

| Sample | Sulfide | PAN | Copper | Sludge (mg) | N. N. | % $\Delta V_{100}$ |
|---|---|---|---|---|---|---|
| H | 0.25 | 0.5 | 1-5 | 7.0 | 0 | + 5.4 |

A Didecyl 6,6'-thiodihexanoate
B Dodecyl 6-[2-(dodecyloxycarbonyl)ethyl]-thio-hexanoate
C 2-(2',6'-dimethyl-2'-octene-8-yl thio)-1-methyl imidazole
D Dibenzyl disulfide
E 4,5-dihydro-2-[(3,7-dimethyl 6-octenyl)thio]thiazole
F Dithiobis(0,0-diamyl phosphorothionate)
G Distearyl-3,3'-thiodipropionate
H Ditridecyl-3,3'-thiodipropionate

EXAMPLE XIII

This example shows the use of a polydecene oil (Gulf Synfluid LS-6485) having no unsaturation and a molecular weight of about 500. The sulfide used in the tests was dilauryl-3,3'-thiodipropionate, the amine was either phenyl-α-naphthylamine or LO-6 as previously defined, and the metal was copper in the form of a metal washer. The sampls were prepared as in Example I. In each case where the synergistic antioxidant system was used, the weight change of the metals was essentially zero.

TABLE XIII

| Sample | DLTDP | Amine & Amt. | Sludge (mg) | N. N. | % $\Delta V_{100}$ |
|---|---|---|---|---|---|
| A | 0 | 0 | Sample would not filter | | |
| B | 0.25 | PAN 0.5 | 7.8 | 0 | + 7.9 |
| C | 0.25 | PAN 0.35 | 2.9 | 0 | + 5.8 |
| D | 0.25 | L06 0.75 | 2.8 | 0.56 | +11.0 |
| E | 0.4 | L06 0.7 | 1.4 | 0.88 | + 6.5 |

EXAMPLE XIV

This example illustrates the degree of degradation of a commercially available polydecene oil (Mobile SHC-624) containing a proprietary antioxidant system in comparison with sample A of Example I. It was tested fifteen times in accordance with the above test procedure, including the four metal washers to determine metal corrosion. The average values are given below in Table XIV. The results demonstrate that the synergistic antioxidant system of the instant invention is markedly superior to this commercial product.

TABLE XIV

| Sample | Sludge (mg) | N. N. | % $\Delta V_{100}$ | Weight Change in grams | | | |
|---|---|---|---|---|---|---|---|
| | | | | Mg | Fe | Cu | Ag |
| Mobil SHC 624 | 91.8 | 7.7 | +21.3 | −.0058 | +.0004 | −.0009 | +.0002 |
| Example IA | 2.6 | 0 | + 1.8 | −.0001 | −.0001 | −.0001 | −.0003 |

We claim:

1. An antioxidant stabilized oil comprising:

(a) a hydrocarbon oil selected from synthetic hydrocarbon oils prepared from an alpha-olefin having 3 to 14 carbon atoms, having an average molecular weight between about 280 and 1000, and less than about 0.25 mole of C=C per 1000 grams of oil, and hydrocarbon based mineral oils which are substantially acid free and which possess less than 0.15 mole of C=C per 1000 grams of oil; and (b) a phenylated naphthylamine;

(c) a sulfur-containing compound being selected from compounds of the formulae R—S—R and R—S-S—R wherein the R groups are the same or different and are selected from the group consisting of alkyl, aryl, aralkyl, alkaryl, alkanoate, thiazole, imidazole, phosphorothionate, and β-ketoalkyl radicals, and where applicable, said sulfur containing compound contains no more than one phenyl to sulfur bond; and (d) a metal selected from the Groups VIII, Ib and IIb of the Periodic Table and having an atomic number greater than 26 with the exception of silver (47); wherein (b) is present in from about 0.15 to 1.25 parts, and (c) is present in from about 0.05 to 4 parts, both by weight per 100 parts of (a), and (d) is present in .01 to 25 parts per million of (a).

2. The stabilized oil of claim 1 wherein the oil is a synthetic hydrocarbon oil.

3. The stabilized oil of claim 2 wherein the oil has less than 0.15 mole of C=C per 1000 grams of oil.

4. The stabilized oil of claim 2 wherein the oil has less than 0.05 mole of C=C per 1000 grams of oil.

5. The stabilized oil of claim 1 wherein the phenylated naphthylamine is selected from the oxidized and unoxidized forms of compounds of the following formulae:

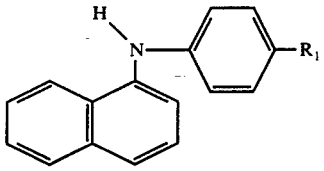

and

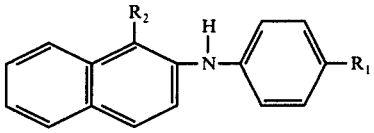

wherein $R_1$ and $R_2$ are each selected from hydrogen, alkyl with 1 to 12 carbon atoms, aryl with 6 to 20 carbon atoms, and aralkyl and alkaryl with 7 to 20 carbon atoms.

6. The stabilized oil of claim 5 wherein the phenylated naphthylamine is selected from the group consisting of phenyl-α-naphthylamine, N-(4-alpha, alpha-dimethylbenzyl phenyl)-α-naphthylamine, p-octyl-α-naphthylamine, phenyl-β-naphthylamine.

7. The stabilized oil of claim 1 wherein the phenylated naphthylamine is phenyl-α-naphthylamine.

8. The stabilized oil of claim 1 wherein the phenylated naphthylamine is present in about 0.2 to 0.7 part by weight.

9. The stabilized oil of claim 1 wherein the phenylated naphthylamine is present in about 0.3 to 0.6 part by weight.

10. The stabilized oil of claim 1 wherein the sulfur-containing compound is a thiodialkanoate of the formula $$-S\,[(CH_2)_xCOOR]_2$$

wherein $x$ is an integer from 2 to 5 and R is an alkyl radical with from about 4 to 20 carbon atoms.

11. The stabilized oil of claim 10 wherein the sulfur-containing compound is dilauryl-3,3'-thiodipropionate.

12. The stabilized oil of claim 1 wherein the sulfur-containing compound is of the formula R—S—R with the R groups being selected from the group consisting of alkyl with 1 to 20 carbon atoms, aryl with 6 to 20 carbon atoms, alkaryl with 7 to 20 carbon atoms, aralkyl with 7 to 20 carbon atoms, thiazole, imidazole, phosphorothionate, and β-ketoalkyl with 3 to 20 carbon atoms.

13. The stabilized oil of claim 12 wherein the sulfur-containing compound is selected from the group consisting of m-bis(thio-2-phenylethyl)benzene, phenyl-3,7-dimethyl-6-octenyl sulfide, dibenzyl sulfide, 2-benzyl thioacetophenone, bis(2-phenylethyl)sulfide, benzyl-2-phenylethyl sulfide, benzyl methyl sulfide, benzyl ethyl sulfide, methyl-2-phenylethyl sulfide, benzyl-3,7-dimethyl-6-octenyl sulfide, didodecyl sulfide, didecyl 6,6'-thiodihexanoate, dodecyl 6-[2-(dodecyloxycarbonyl)ethyl]-thiohexanoate, 2-(2',6'-dimethyl-2'-octene-8-yl thio)-1-methyl imidazole, 4,5-dihydro-2-[(3,7-dimethyl 6-octenyl)thio]thiazole, dithiobis (O,O-diamyl phosphorothionate), distearyl-3,3-thio-dipropionate, ditridecyl-3,3'-thiodiproponate, and 2-benzyl thioacetophenone.

14. The stabilized oil of claim 1 wherein the sulfur-containing compound is dibenzyl disulfide.

15. The stabilized oil of claim 1 wherein the sulfur-containing compound is present in about 0.2 to 1.0 part by weight.

16. The stabilized oil of claim 1 wherein the metal is selected from the group consisting of cobalt, nickel, copper, zinc and rhodium.

17. The stabilized oil of claim 1 wherein the metal is added to the oil in elementary form.

18. The stabilized oil of claim 1 wherein the metal is added to the oil in the form of an oil soluble metal salt.

19. The stabilized oil of claim 1 wherein the metal is copper and is present in from about 1 to 10 parts per million.

20. The stabilized synthetic hydrocarbon oil of claim 2 wherein the phenylated naphthylamine is selected from the oxidized and unoxidized forms of compounds of the following formulae:

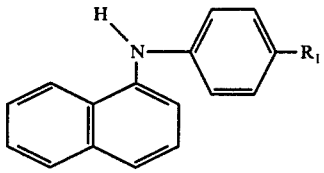

and

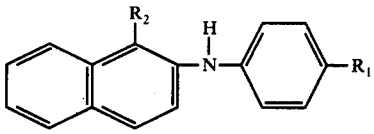

wherein $R_1$ and $R_2$ are each selected from hydrogen, alkyl with 1 to 12 carbon atoms, aryl with 6 to 20 carbon atoms, and aralkyl and alkaryl with 7 to 20 carbon atoms.

21. The stabilized synthetic hydrocarbon oil of claim 20 wherein the phenylated naphthylamine is selected from the group consisting of phenyl-α-naphthylamine, N-(4-alpha, alpha-dimethylbenzyl phenyl)-α-naphthylamine, p-octyl-α-naphthylamine, phenyl-β-naphthylamine.

22. The stabilized synthetic hydrocarbon oil of claim 2 wherein the phenylated naphthylamine is phenyl-α-naphthylamine.

23. The stabilized synthetic hydrocarbon oil of claim 2 wherein the phenylated naphthylamine is present in about 0.2 to 0.7 part by weight.

24. The stabilized synthetic hydrocarbon oil of claim 2 wherein the phenylated naphthylamine is present in about 0.3 to 0.6 part by weight.

25. The stabilized synthetic hydrocarbon oil of claim 2 wherein the sulfur-containing compound is a thiodialkanoate of the formula $$-S-(CH_2)_xCOOR]_2$$

wherein $x$ is an integer from 2 to 5 and R is an alkyl radical with from about 4 to 20 carbon atoms.

26. The stabilized synthetic hydrocarbon oil of claim 25 wherein the sulfur-containing compound is dilauryl-3,3'-thiodipropionate.

27. The stabilized synthetic hydrocarbon oil of claim 2 wherein the sulfur-containing compound is of the formula R—S—R with the R groups being selected from the group consisting of alkyl with 1 to 20 carbon atoms, aryl with 6 to 20 carbon atoms, alkaryl with 7 to 20 carbon atoms, aralkyl with 7 to 20 carbon atoms, thiazole, imidazole, phosphorothionate, and $\beta$-ketozlkyl with 3 to 20 carbon atoms.

28. The stabilized synthetic hydrocarbon oil of claim 2 wherein the sulfur-containing compound is selected from the group consisting of m-bis(thio-2-phenylethyl)-benzene, phenyl-3,7-dimethyl-6-octenyl sulfide, dibenzyl sulfide, 2-benzyl thioacetophenone, bis-(2-phenylethyl)sulfide, benzyl-2-phenylethyl sulfide, benzyl methyl sulfide, benzyl ethyl sulfide, methyl-2-phenylethyl sulfide, benzyl-3,7-dimethyl-6-octenyl sulfide, didodecyl sulfide, didecyl 6,6'-thiodihexanoate, dodecyl 6-[2-(dodecyloxycarbonyl)ethyl]-thiohexanoate, 2-(2',6'-dimethyl-2'-octene-8-yl thio)-1-methyl imidazole, 4,5-dihydro-2-[(3,7-dimethyl 6-octenyl)thio]-thiazole, dithiobis O,O -diamyl phosphorothionate), distearyl-3,3-thiodipropionate, ditridecyl-3,3'-thiodiproponate, and 2-benzyl thioacetophenone.

29. The stabilized synthetic hydrocarbon oil of claim 2 wherein the sulfur-containing compound is dibenzyl disulfide.

30. The stabilized synthetic hydrocarbon oil of claim 2 wherein the sulfur-containing compound is present in about 0.2 to 1.0 part by weight.

31. The stabilized synthetic hydrocarbon oil of claim 2 wherein the metal is selected from the group consisting of cobalt, nickel, copper, zinc and rhodium.

32. The stabilized synthetic hydrocarbon oil of claim 2 wherein the metal is added to the oil in elementary form.

33. The stabilized synthetic hydrocarbon oil of claim 2 wherein the metal is added to the oil in the form of an oil soluble metal salt.

34. The stabilized synthetic hydrocarbon oil of claim 2 wherein the metal is copper and is present in from about 1 to 10 parts per million.

35. The stabilized synthetic hydrocarbon oil of claim 2 wherein the phenylated naphthylamine is selected from the group consisting of phenyl-$\alpha$-naphthylamine, N-(4-alpha, alpha-dimethylbenzyl phenyl)-$\alpha$-naphthylamine, p-octyl-$\alpha$-naphthylamine, phenyl-$\beta$-naphthylamine; the sulfur-containing compound is selected from the group consisting of m-bis(thio-2-phenylethyl)benzene, phenyl-3,7-dimethyl-6-octenyl sulfide, dibenzyl sulfide, 2-benzyl thioacetophenone, bis(2-phenylethyl)-sulfide, benzyl-2-phenylethyl sulfide, benzyl methyl sulfide, benzyl ethyl sulfide, methyl-2-phenylethyl sulfide, benzyl-3,7-dimethyl-6-octenyl sulfide, didodecyl sulfide didecyl 6,6'-thiodihexanoate, dodecyl 6-[2-(dodecyloxycarbonyl)ethyl]-thiohexanoate, 2-(2',6'-dimethyl-2'-octene-8-yl thio)-1-methyl imidazole, 4,5-dihydro-2-[(3,7-dimethyl 6-octenyl)thio]thiazole, dithiobis O,O-diamyl phosphorothionate), distearyl-3,3-thiodipropionate, ditridecyl-3,3'-thiodiproponate, dilaurel-3,3'-thiodipropionate and 2-benzyl thioacetophenone; and the metal is selected from the group consisting of cobalt, nickel, copper, zinc and rhodium.

36. The stabilized synthetic hydrocarbon oil of claim 35 wherein the oil is a polyoctene, the phenylated naphthylamine is phenyl-$\alpha$-naphthylamine, the sulfur containing compound is dilaurel-3,3'-thiodipropionate and the metal is copper.

37. The stabilized synthetic hydrocarbon oil of claim 35 wherein the oil is a polydecene, the phenylated naphthylamine is phenyl-$\alpha$-naphthylamine, the sulfur containing compound is dilaurel-3,3'-thiodipropionate and the metal is copper.

38. The stabilized oil of claim 1 wherein the oil is a hydrocarbon-based mineral oil which is substantially acid free.

39. The stabilized mineral oil of claim 38 wherein the oil has less than 0.05 mole of C=C per 1000 grams of oil.

40. The stabilized mineral oil of claim 38 wherein the phenylated naphthylamine is selected from the oxidized and unoxidized forms of compounds of the following formulae:

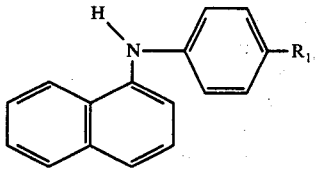

and

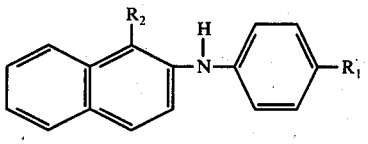

wherein $R_1$ and $R_2$ are each selected from hydrogen, alkyl with 1 to 12 carbon atoms, aryl with 6 to 20 carbon atoms, and aralkyl and alkaryl with 7 to 20 carbon atoms.

41. The stabilized mineral oil of claim 40 wherein the phenylated naphthylamine is selected from the group consisting of phenyl-$\alpha$-naphthylamine, N-(4-alpha, alpha-dimethylbenzyl phenyl)-$\alpha$-naphthylamine, p-octyl-$\alpha$-naphthylamine, phenyl-$\beta$-naphthylamine.

42. The stabilized mineral oil of claim 38 wherein the phenylated naphthylamine is phenyl-$\alpha$-naphthylamine.

43. The stabilized mineral oil of claim 38 wherein the phenylated naphthylamine is present in about 0.2 to 0.7 part by weight.

44. The stabilized mineral oil of claim 38 wherein the phenylated naphthylamine is present in about 0.3 to 0.6 part by weight.

45. The stabilized mineral oil of claim 38 wherein the sulfur-containing compound is a thiodialkanoate of the formula $-S-(CH_2)_x COOR]_2$ wherein $x$ is an integer from 2 to 5 and R is an alkyl radical with from about 4 to 20 carbon atoms.

46. The stabilized mineral oil of claim 10 wherein the sulfur-containing compound is dilauryl-3,3'-thiodipropionate.

47. The stabilized mineral oil of claim 38 wherein the sulfur-containing compound is of the formula R—S—R with the R groups being selected from the group consisting of alkyl with 1 to 20 carbon atoms, aryl with 6 to 20 carbon atoms, alkaryl with 7 to 20 carbon atoms, aralkyl with 7 to 20 carbon atoms, thiazole, imidazole, phosphorothionate, and β-ketoalkyl with 3 to 20 carbon atoms.

48. The stabilized mineral oil of claim 38 wherein the sulfur-containing compound is selected from the group consisting of m-bis(thio-2-phenylethyl)benzene, phenyl-3,7-dimethyl-6-octenyl sulfide, dibenzyl sulfide, 2-benzyl thioacetophenone, bis(2-phenylethyl) sulfide, benzyl-2-phenylethyl sulfide, benzyl methyl sulfide, benzyl ethyl sulfide, methyl-2-phenylethyl sulfide, benzyl-3,7-dimethyl-6-octenyl sulfide, didodecyl sulfide, didecyl 6,6'-thiodihexanoate, dodecyl 6-[2-(dodecyloxycarbonyl)ethyl]-thiohexanoate, 2,2',6'-dimethyl-2'-octene-8-yl thio)-1-methyl imidazole, 4,5-dihydro-2-[(3,7-dimethyl 6-octenyl)thio]thiazole, dithiobis O,O-diamyl phosphorothionate), distearyl-3,3-thiodipropionate, ditridecyl-3,3'-thiodiproponate, and 2-benzyl thioacetophenone.

49. The stabilized mineral oil of claim 38 wherein the sulfur-containing compound is dibenzyl disulfide.

50. The stabilized mineral oil of claim 38 wherein the sulfur-containing compound is present in about 0.2 to 1.0 part by weight.

51. The stabilized mineral oil of claim 38 wherein the metal is selected from the group consisting of cobalt, nickel, copper, zinc and rhodium.

52. The stabilized mineral oil of claim 38 wherein the metal is added to the oil in elementary form.

53. The stabilized mineral oil of claim 38 wherein the metal is added to the oil in the form of an oil soluble metal salt.

54. The stabilized mineral oil of claim 38 wherein the metal is copper and is present in from about 1 to 10 parts per million.

55. The stabilized mineral oil of claim 38 wherein the phenylated naphthylamine is selected from the group consisting of phenyl-α-naphthylamine, N-(4-alpha, alpha-dimethylbenzyl phenyl)-α-naphthylamine, p-octyl-α-naphthylamine, phenyl-β-naphthylamine; the sulfur-containing compound is selected from the group consisting of m-bis(thio-2-phenylethyl)benzene, phenyl-3,7-dimethyl-6-octenyl sulfide, dibenzyl sulfide, 2-benzyl thioacetophenone, bis(2-phenylethyl)sulfide, benzyl-2-phenylethyl sulfide, benzyl methyl sulfide, benzyl ethyl sulfide, methyl-2-phenylethyl sulfide, benzyl-3,7-dimethyl-6-octenyl sulfide, didodecyl sulfide, didecyl 6,6'-thiodihexanoate, dodecyl 6-[2-(dodecyloxycarbonyl)ethyl]-thiohexanoate, 2-(2',6'-dimethyl-2'-octane-8-yl thio)-1-methyl imidazole, 4,5-dihydro-2-[(3,7-dimethyl 6-octenyl)-thio]thiazole, dithiobis (O,O-diamyl phosphorothionate), dilaurel-3,3'-thiodipropionate, distearyl-3,3-thiodipropionate ditridecyl-3,3'-thiodiproponate, and 2-benzyl thioacetophenone; and the metal is selected from the group consisting of cobalt, nickel, copper, zinc and rhodium.

56. The stabilized mineral oil of claim 55 wherein the phenylated naphthylamine is phenyl-α-naphthylamine, the sulfur containing compound is dilaurylthiodipropionate and the metal is copper.

57. An antioxidant additive system for use in a hydrocarbon oil selected from synthetic hydrocarbon oils prepared from an alpha-olefin having from 3 to 14 carbon atoms, an average molecular weight between about 280 and 1000 and less than about 0.25 mole of C=C per 1000 grams of oil, and hydrocarbon based mineral oils which are substantially acid free and which possess less than about 0.15 mole of C=C per 1000 grams of oil, comprising:

(a) a phenylated naphthylamine;

(b) a sulfur-containing compound being selected from compounds of the formulae R—S—R and R—S-S—R wherein the R groups are the same or different and are selected from the group consisting of alkyl, aryl, aralkyl, alkaryl, alkanoate, thiazole, imidazole, phosphorothionate and β-ketoalkyl radicals, and where applicable with the proviso that said sulfur-containing compound contains no more than one phenyl to sulfur bond; and (c) a metal selected from Groups VIII, Ib and IIb of the Periodic Table and having an atomic number greater than 26 with the exception of silver; and wherein (a) is present in about 0.15 to 1.25 parts and (b) is present in from about 0.05 to 4 parts, both by weight, per 100 parts of oil, and (c) is present in from 0.01 to 25 parts per million of the oil.

58. The antioxidant combination of claim 57 wherein the phenylated naphthylamine is selected from the oxidized and unoxidized forms of compounds of the following formulae:

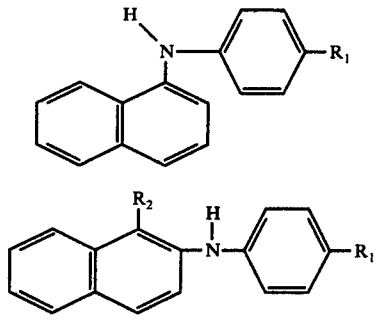

where $R_1$ and $R_2$ are each selected from hydrogen, alkyl with 1 to 12 carbon atoms, aryl with 6 to 20 carbon atoms, and aralkyl and alkaryl with 7 to 20 carbon atoms.

59. The antioxidant combination of claim 58 wherein the phenylated naphthylamine is phenyl-α-naphthylamine.

60. The antioxidant combination of claim 57 wherein the phenylated naphthylamine is added to the oil in from about 0.2 to 0.7 part by weight.

61. The antioxidant combination of claim 57 wherein the sulfur-containing compound is a thiodialkanoate of the formula $-S[(CH_2)_x COOR]_s$ wherein $x$ is an integer from 2 to 5 and R is an alkyl radical with from about 4 to 20 carbon atoms.

62. The antioxidant combination of claim 61 wherein the thiodialkanoate is dilauryl-3,3'-thiodipropionate.

63. The antioxidant combination of claim 57 wherein the sulfur-containing compound is of the formula R—S—R with the R groups being selected from the group consisting of alkyl with 1 to 20 carbon atoms, aryl with 6 to 20 carbon atoms, alkaryl with 7 to 20 carbon atoms, aralkyl with 7 to 20 carbon atoms, thiazole, imidazole, phosphorothionate, and β-ketoalkyl with 3 to 20 carbon atoms.

64. The antioxidant combination of claim 57 wherein the sulfur-containing compound is added to the oil in about 0.2 to 1.0 part by weight.

65. The antioxidant combination of claim 57 wherein the metal is selected from the group consisting of cobalt, nickel, copper, zinc and rhodium.

66. The antioxidant combination of claim 65 wherein the metal is included in the elementary form.

67. The antioxidant combination of claim 65 wherein the metal is included in the form of an oil soluble metal salt.

68. A method of stabilizing a hydrocarbon oil selected from synthetic hydrocarbon oils prepared from an alpha-olefin having from 3 to 14 carbon atoms, an average molecular weight between about 280 and 1000 and less than about 0.25 mole of C=C per 1000 grams of oil, and hydrocarbon based mineral oils which are substantially acid free and which possess less than 0.15 mole of C=C per 1000 grams of oil comprising combining therewith (a) a phenylated naphthylamine, (b) a sulfide compound selected from compounds of the formulae R—S—R and R—SS—R wherein the R groups are the same or different and are selected from the group consisting of alkyl, aryl, aralkyl, alkaryl, alkanoate, thiazole, imidazole, phosphorothionate, and β-ketoalkyl radicals, and where applicable said sulfur-containing compound contains no more than one phenyl to sulfur bond; and (c) a metal selected from Groups VIII, Ib and IIb of the Periodic Table and having an atomic number greater than 26, with the exception of silver; and wherein (a) is present in from about 0.15 to 1.25 parts, and (b) is present in from about 0.05 to 4 parts, both by weight per 100 parts of oil, and (c) is present in from about 0.01 to 25 parts per million of the oil.

69. The method of claim 68 wherein the phenylated naphthylamine is selected from the oxidized and unoxidized forms of compounds of the following formulae:

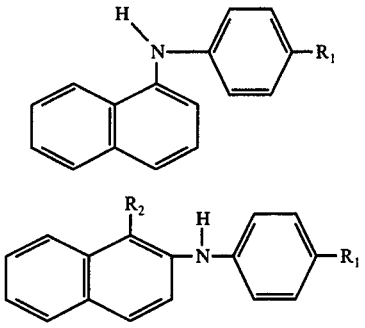

where $R_1$ and $R_2$ are each selected from hydrogen, alkyl with 1 to 12 carbon atoms, aryl with 6 to 20 carbon atoms, and aralkyl and alkaryl with 7 to 20 carbon atoms.

70. The method of claim 67 wherein the phenylated naphthylamine is phenyl-α-naphthylamine.

71. The method of claim 68 wherein the phenylated naphthylamine is added to the oil in from about 0.2 to 0.7 part by weight.

72. The method of claim 68 wherein the sulfur-containing compound is a thiodialkanoate of the formula $$-S-(CH_2)_xCOOR]_2$$

wherein $x$ is an integer from 2 to 5 and R is an alkyl radical with from about 4 to 20 carbon atoms.

73. The method of claim 72 wherein the thiodialkanoate is dilauryl-3,3'-thiodipropionate.

74. The method of claim 68 wherein the sulfur-containing compound is of the formula R—S—R with the R groups being selected from the group consisting of alkyl with 1 to 20 carbon atoms, aryl with 6 to 20 carbon atoms, alkaryl with 7 to 20 carbon atoms, aralkyl with 7 to 20 carbon atoms, thiazole, imidazole, phosphorothionate, and β-ketoalkyl with 3 to 20 carbon atoms.

75. The method of claim 68 wherein the sulfur-containing compound is added to the oil in about 0.2 to 1.0 part by weight.

76. The method of claim 68 wherein the metal is selected from the group consisting of cobalt, nickel, copper, zinc and rhodium.

77. The method of claim 76 wherein the metal is included in the elementary form.

78. The method of claim 76 wherein the metal is included in the form of an oil soluble metal salt.

79. The method of claim 68 wherein the phenylated naphthylamine is selected from the group consisting of phenyl-α-naphthylamine, N-(4-alpha, alpha-dimethylbenzyl phenyl)-α-naphthylamine, p-octyl-α-naphthylamine phenyl-β-naphthylamine; the sulfur-containing compound is selected from the group consisting of m-bis(thio-2-phenylethyl) benzene, phenyl-3,7-dimethyl-6-octenyl sulfide, dibenzyl sulfide, 2-benzyl thioacetophenone, bis(2-phenylethyl)sulfide, benzyl-2-phenylethyl sulfide, benzyl methyl sulfide, benzyl ethyl sulfide, methyl-2-phenylethyl sulfide, benzyl-3,7-dimethyl-6-octenyl sulfide, didodecyl sulfide, didecyl 6,6'-thiodihexanoate, dodecyl 6-[2-(dodecyloxycarbonyl)ethyl]-thiohexanoate, 2-(2',6'-dimethyl-2'-octene-8-yl thio)-1-methyl imidazole, 4,5-dihydro-2-[(3,7-dimethyl 6-octenyl)thio]thiazole, dithiobis (O,O-diamyl phosphorothionate), dilaurel-3,3'-thiodipropionate, distearyl-3,3-thiodipropionate, ditridecyl-3,3'-thiodipropionate, and 2-benzyl thioacetophenone; and the metal is selected from the group consisting of cobalt, nickel, copper, zinc and rhodium.

80. The method of claim 79 wherein the oil is a polyoctene, the phenylated naphthylamine is phenyl-α-naphthylamine, the sulfur-containing compound is dilaurel-3,3'-thiodipropionate and the metal is copper.

81. The method of claim 79 wherein the oil is a polydecene, the phenylated naphthylamine is phenyl-α-naphthylamine, the sulfur-containing compound is dilaurel-3,3'-thiodipropionate and the metal is copper.

82. The method of claim 79 wherein the phenylated naphthylamine is phenyl-α-naphthylamine, the sulfur-containing compound is dilaurylthiodipropionate and the metal is copper.

* * * * *